US007691186B2

(12) United States Patent
Wiser

(10) Patent No.: US 7,691,186 B2
(45) Date of Patent: Apr. 6, 2010

(54) CONDUCTIVE BEAD ACTIVE FIELD POLARIZED MEDIA AIR CLEANER

(75) Inventor: Forwood C Wiser, Kingston, NJ (US)

(73) Assignee: Environmental Management Confederation, Inc., Princeton, NJ (US)

( * ) Notice: Subject to any disclaimer, the term of this patent is extended or adjusted under 35 U.S.C. 154(b) by 320 days.

(21) Appl. No.: 11/618,543

(22) Filed: Dec. 29, 2006

(65) Prior Publication Data

US 2007/0199451 A1 Aug. 30, 2007

(51) Int. Cl.
*B03C 3/30* (2006.01)

(52) U.S. Cl. ..... 96/17; 55/382; 55/521; 55/DIG. 39; 96/67; 96/69

(58) Field of Classification Search ..... 96/17, 96/66, 67, 69, 80; 95/59; 55/497, 521, 524, 55/DIG. 39, 341.1, 361, 381, 382
See application file for complete search history.

(56) References Cited

U.S. PATENT DOCUMENTS

| | | | | | |
|---|---|---|---|---|---|
| 2,571,079 | A | * | 10/1951 | Warburton | 96/67 |
| 2,908,348 | A | * | 10/1959 | Rivers et al. | 96/67 |
| 3,073,094 | A | | 1/1963 | Landgraf et al. | |
| 3,471,695 | A | | 10/1969 | Hudson et al. | |
| 3,509,696 | A | | 5/1970 | Thompson | |
| 4,549,887 | A | | 10/1985 | Joannou | |
| 4,555,252 | A | | 11/1985 | Eckstein | |
| 4,715,870 | A | * | 12/1987 | Masuda et al. | 96/67 |
| 4,750,921 | A | * | 6/1988 | Sugita et al. | 96/67 |
| 4,828,586 | A | | 5/1989 | Joannou | |
| 4,853,005 | A | | 8/1989 | Jaisinghani et al. | |
| 4,886,526 | A | | 12/1989 | Joannou | |
| 4,889,542 | A | | 12/1989 | Hayes | |
| 4,902,306 | A | | 2/1990 | Burnett et al. | |
| 4,978,372 | A | | 12/1990 | Pick | |
| 5,192,342 | A | | 3/1993 | Baron et al. | |
| 5,240,478 | A | | 8/1993 | Messina | |
| 5,322,473 | A | | 6/1994 | Hofstra et al. | |
| 5,330,559 | A | | 7/1994 | Cheney et al. | |
| 5,330,722 | A | | 7/1994 | Pick et al. | |
| 5,336,299 | A | | 8/1994 | Savell | |
| 5,360,469 | A | | 11/1994 | Baron et al. | |
| 5,417,433 | A | | 5/1995 | Phillips | |
| 5,441,279 | A | | 8/1995 | Messina | |
| 5,474,599 | A | | 12/1995 | Cheney et al. | |
| 5,573,577 | A | | 11/1996 | Joannou | |
| 5,616,172 | A | | 4/1997 | Tuckerman et al. | |
| 5,627,376 | A | | 5/1997 | Jaisinghani et al. | |
| 5,730,770 | A | | 3/1998 | Greisz | |
| 5,807,425 | A | | 9/1998 | Gibbs | |
| 5,846,302 | A | | 12/1998 | Putro | |

(Continued)

FOREIGN PATENT DOCUMENTS

| | | |
|---|---|---|
| CA | 1272453 | 8/1990 |

(Continued)

*Primary Examiner*—Richard L Chiesa
(74) *Attorney, Agent, or Firm*—Volpe And Koenig, P.C.

(57) ABSTRACT

A pleated filter media includes a plurality of parallel conductive beads to support the media and space the pleated surfaces apart. A high voltage differential applied between adjacent conductive beads induces an electrostatic field within the filter media, thereby increasing the efficiency of the filter.

18 Claims, 3 Drawing Sheets

U.S. PATENT DOCUMENTS

| | | | | |
|---|---|---|---|---|
| 5,888,274 | A * | 3/1999 | Frederick | 95/59 |
| 5,997,619 | A | 12/1999 | Knuth et al. | |
| 6,063,167 | A | 5/2000 | Rutkowski | |
| 6,077,334 | A | 6/2000 | Joannou | |
| 6,099,607 | A | 8/2000 | Haslebacher | |
| 6,294,004 | B1 | 9/2001 | Summers et al. | |
| 6,428,610 | B1 | 8/2002 | Tsai et al. | |
| 6,464,760 | B1 | 10/2002 | Sham et al. | |
| 6,491,743 | B1 * | 12/2002 | Joannou et al. | 96/67 |
| 6,497,754 | B2 | 12/2002 | Joannou | |
| 6,514,324 | B1 | 2/2003 | Chapman | |
| 6,544,309 | B1 | 4/2003 | Hoefer et al. | |
| 6,547,860 | B2 * | 4/2003 | Buchwald et al. | 96/17 |
| 6,572,685 | B2 | 6/2003 | Dunshee | |
| 6,723,150 | B2 | 4/2004 | Parker | |
| 6,764,533 | B2 | 7/2004 | Lobiondo, Jr. | |
| 6,955,708 | B1 | 10/2005 | Julos et al. | |
| 6,984,259 | B2 | 1/2006 | Hurst | |
| 7,014,688 | B2 | 3/2006 | Griffiths et al. | |
| 7,025,806 | B2 * | 4/2006 | Coppom et al. | 95/59 |
| 7,112,232 | B2 | 9/2006 | Chang et al. | |
| 7,150,780 | B2 | 12/2006 | Krichtafovitch et al. | |
| 7,323,146 | B2 | 1/2008 | Kim et al. | |
| 7,364,607 | B2 * | 4/2008 | Ueda et al. | 96/67 |
| 7,367,997 | B1 | 5/2008 | Isogawa | |
| 7,445,654 | B2 | 11/2008 | Wong | |
| 7,455,706 | B2 | 11/2008 | Latham et al. | |
| 7,459,002 | B2 | 12/2008 | Kalous et al. | |
| 2002/0021194 | A1 | 2/2002 | Maehara et al. | |
| 2004/0144254 | A1 | 7/2004 | Wiser et al. | |
| 2005/0045036 | A1 * | 3/2005 | Vetter et al. | 96/66 |
| 2005/0172812 | A1 * | 8/2005 | Ueda et al. | 96/67 |
| 2006/0137527 | A1 | 6/2006 | Joannou | |
| 2006/0180023 | A1 | 8/2006 | Coppom et al. | |

FOREIGN PATENT DOCUMENTS

| | | | | |
|---|---|---|---|---|
| DE | 3339828 | A1 * | 5/1985 | 96/97 |
| JP | 355024561 | A | 2/1980 | |
| RU | 2240856 | | 12/1990 | |
| RU | 2026751 | | 1/1995 | |

* cited by examiner

CONDUCTIVE BEAD ACTIVE FIELD POLARIZED MEDIA AIR CLEANER

FIELD OF INVENTION

The present invention relates generally to air cleaning systems and is particularly directed to air cleaners of the type that use an electrostatic field to polarize a media and to polarize particles to increase the particle collection efficiency on the media.

BACKGROUND OF THE INVENTION

The principal of electrostatic attraction has been used for many years to enhance the removal of contaminants from air streams. There are three primary categories of air electrostatic cleaners: electrostatic precipitators, passive electrostatic filters and active field polarized media air cleaners, which are sometimes known under different terms.

Electrostatic precipitators charge particles and then capture them on oppositely charged and/or grounded collection plates.

A passive electrostatic filter (also known as an electret) employs a media (or combination of different media) that through some combination of treatment and/or inherent properties has an electrostatic charge. Particles entering the filter media that have an electrostatic charge are attracted to the charged media filter materials that have the opposite electrostatic charge.

An active field polarized media air cleaner uses an electrostatic field created by a voltage differential between two electrodes. A dielectric filter media is placed in the electrostatic field between the two electrodes. The electrostatic field polarizes both the media fibers and the particles that enter, thereby increasing the efficiency of the media and the air cleaner. A dielectric material is an electrical insulator or a substance that is highly resistant to electric current that can also store electrical energy. A dielectric material tends to concentrate an applied electric field within itself and is thus an efficient supporter of electrostatic fields.

A further electrostatic air filter design is disclosed in Canadian Patent No. 1,272,453, in which a disposable rectangular cartridge is connected to a high voltage power supply. The cartridge consists of a conductive inner center screen, which is sandwiched between two layers of a dielectric fibrous material (either plastic or glass). The two dielectric layers are, in turn, further sandwiched between two outer screens of conductive material. The conductive inner center screen is raised to a high voltage, thereby creating an electrostatic field between the inner center screen and the two conductive outer screens that are kept at an opposite or ground potential. The high voltage electrostatic field polarizes the fibers of the two dielectric layers.

Pleated filters are also well known. A pleated filter is formed from a sheet of filter media folded into a series of pleats. One type of pleated filter, known as a mini-pleat filter, has smaller more closely spaced pleats. The peaks between adjacent pleats of a mini-pleat filter are spaced no more than 20 mm apart and typically range from 5.0 mm to 7.0 mm apart.

Mini-pleat air filters typically utilize ⅞ to 1¼ inch deep pleats with very narrow air spaces (⅛ inch) between, making it possible to pack more filter paper into a standard frame than can be done with traditional deep, corrugated pleats. The abutting folds of a mini-pleat filter are separated and held in place by glue beads, threads, ribbons, tapes, strips of medium, or a continuous piece of glass, foam or plastic spaced within the width of the medium. Mini-pleat filters contain almost twice as much filter paper as deeply pleated filters or corrugated separator filters of equal frame size.

U.S. Pat. No. 2,908,348 to Rivers shows the use of conductive stripes applied to a pleated media for generating electrostatic fields. The stripes serve to create an electrostatic field within the pleated filter media.

U.S. Pat. No. 6,497,754 to Joannou shows a pleated filter with conductive strings attached to the top edges and bottom edges (peaks) of the pleated folds. Applying a high voltage potential between the top and bottom peaks of the pleated folds generates an electrostatic field within the pleated filter material.

SUMMARY OF THE INVENTION

The present invention is embodied in a filter media in which conductive beads are used to support and/or hold together the media and generate an electrostatic field within the media.

The present invention is further embodied in a pleated filter media in which conductive beads or members are used to support the media, space the pleated surfaces apart, add strength to the overall assembly, in a multi-layer media, hold layers together and in all cases generate an electrostatic field within the media.

In accordance with the present invention, an electrostatic field is created within the media by applying a high voltage differential between adjacent conductive beads, thereby increasing the efficiency of the filter.

DETAILED DESCRIPTION

Figure 1:
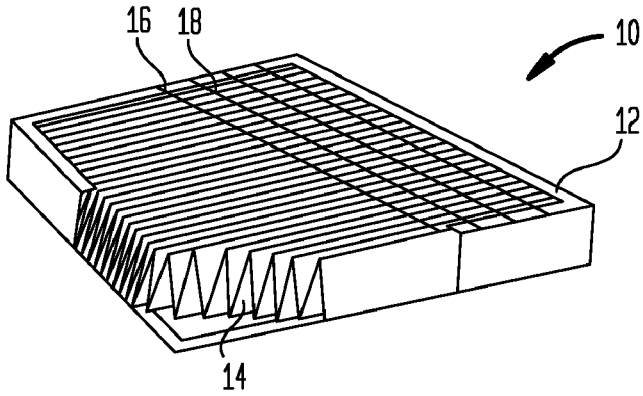
FIG. 1 is a mini-pleat filter containing conductive beads in accordance with the present invention.

A pleated filter 10 shown in FIG. 1 includes a rigid frame 12 of typically plastic or metal that encloses pleated filter material 14. The filter illustrated is a mini-pleat filter with parallel conductive beads holding the pleats of the mini-pleat filter in place. In particular, substantially parallel conductive beads 16 and 18 are illustrated in FIG. 1. Depending upon the size of the mini-pleat filter configuration, there may be one, two or many parallel conductive beads holding the pleated filter material 14 in place.

Figure 2A:
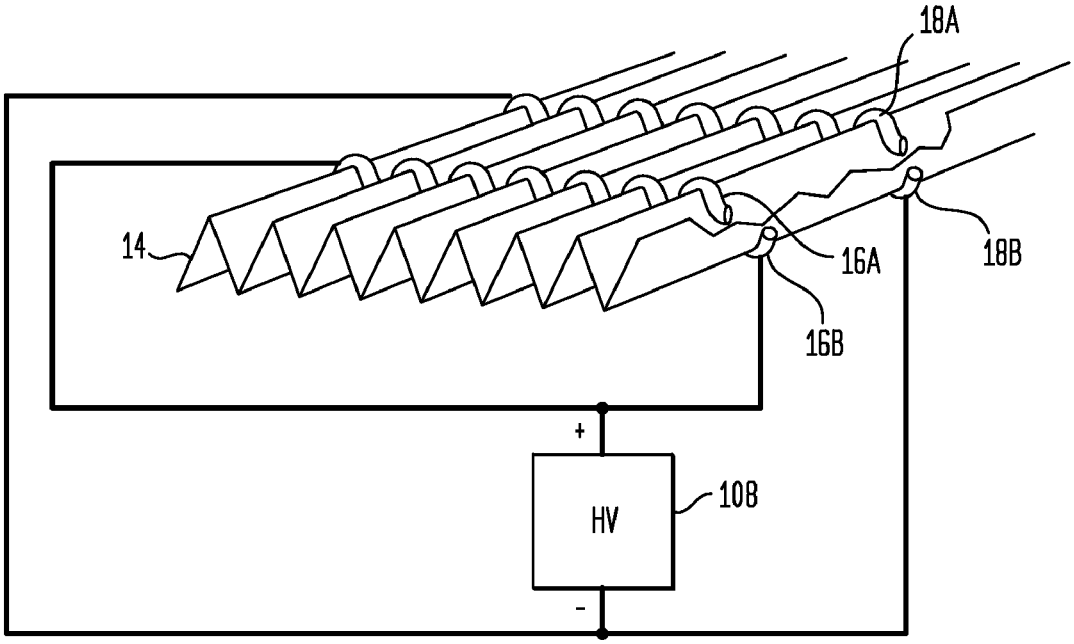
FIG. 2A is an isometric drawing, partially in schematic form, of a mini-pleat filter containing conductive beads in accordance with the present invention.

As shown in FIG. 2A, pleated filter media 14 is held in place by a top conductive bead 16A and a bottom conductive bead 16B that are respectively above and below the pleated filter media 14. Parallel to conductive beads 16A and 16B is an adjacent pair of rows of conductive beads, namely top conductive bead 18A and bottom conducted bead 18B. Typically, parallel rows of conductive beads are spaced one half to three quarters of an inch apart on each side of the filter media 14.

Figure 7:
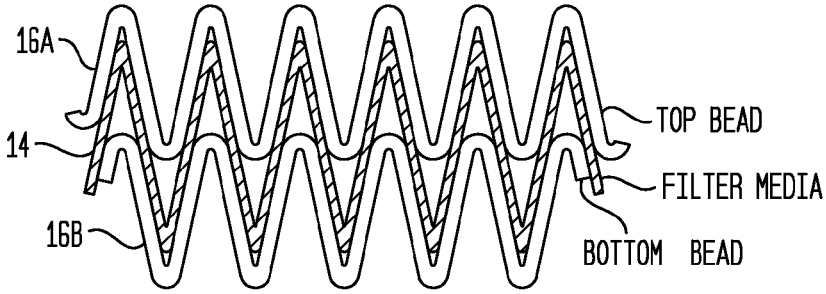
FIG. 7 is a cross-sectional view of the filter media and conductive beads of the filter shown in FIG. 2A in accordance with the present invention.

A cross-sectional view of the filter media and conductive beads from FIG. 2A is shown in FIG. 7. The filter media 14 is sandwiched between the top and bottom conductive beads 16A and 16B. Specifically, the filter media 14 is held in place by the top conductive bead 16A. Additionally, the filter media 14 is held in place by the bottom conductive bead 16B.

Figure 4:
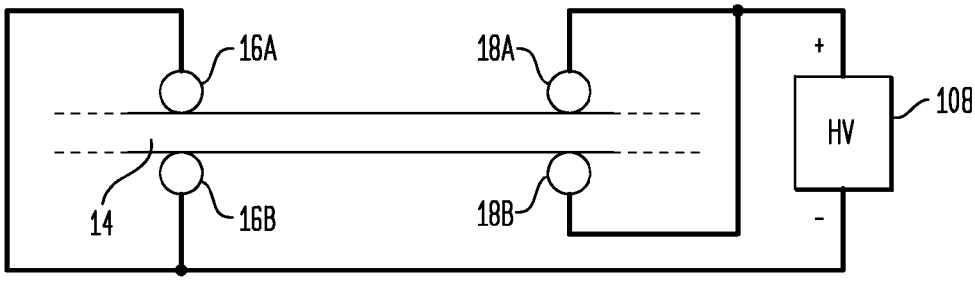
FIG. 4 illustrates a first embodiment for applying an electrostatic field to a filter media in accordance with the present invention.

As shown in both FIG. 2A and FIG. 4, one terminal of a high voltage power supply 108 is coupled to conductive beads 16A and 18A on the top of the media filter 14. The other terminal of the high voltage power supply 108 is coupled to conductive beads 16A and 18B on the bottom of the media filter 14. In one embodiment, the high voltage applied to the conductive beads provides for an electrostatic field ranging from 3-30 kv/cm in the filter material 14.

The spacing between conductive beads and the voltage applied thereto may be selected appropriately so as to generate the desired field strength for the particular filter media. It has been found that when conductive beads were applied to a nominal MERV 11 pleated media and an electrostatic field was established, filter efficiency at 0.3-micron particle size went from 31% to 59% (a 90% increase).

Conductive beads of the present invention may also be applied to filters of different form factors such as a bag or stock filter. Furthermore, the conductive beads of the present invention may also be applied to filters of different filter media. For example, the filter media 14 can be composed of the fibers from different portions of the triboelectric scale (electret). The filter media 14 may be essentially of one filter material or layers of different filter materials.

As used herein the term "bead" means any material such as glue, thread, ribbon, tape, strips, or continuous piece of glass, foam, metal or plastic or any other material that adheres to the surface of the filter media or is made to adhere to the surface of the filter media upon which it rests and provides some mechanical support to such filter media.

Figure 2B:
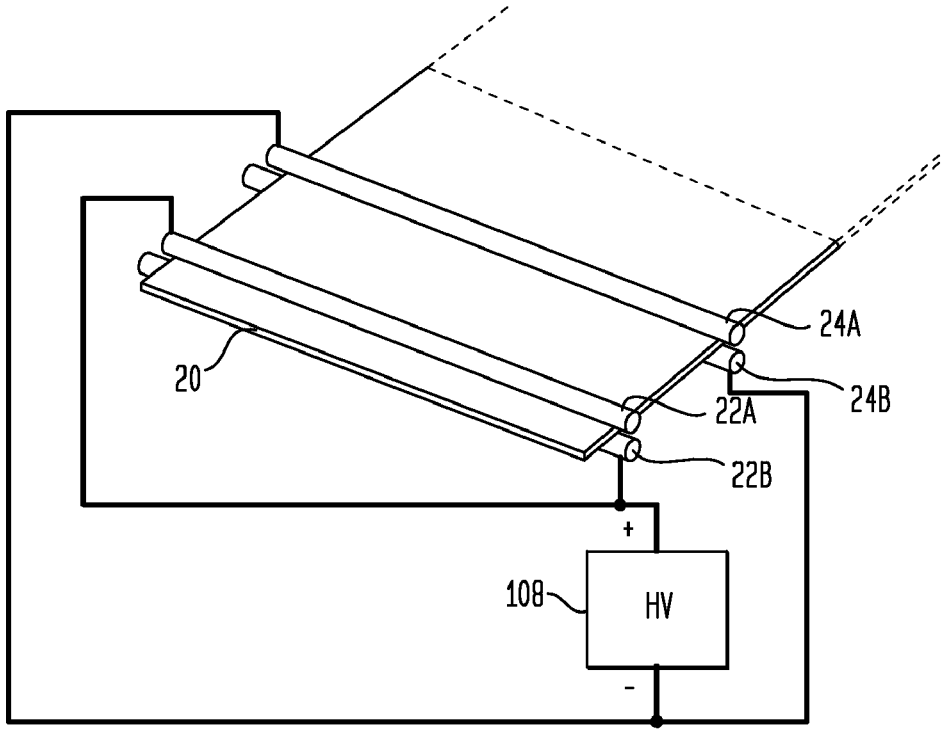
FIG. 2B is an isometric drawing, partially in schematic form, of a non-pleated filter containing conductive beads in accordance with the present invention.
Figure 3:
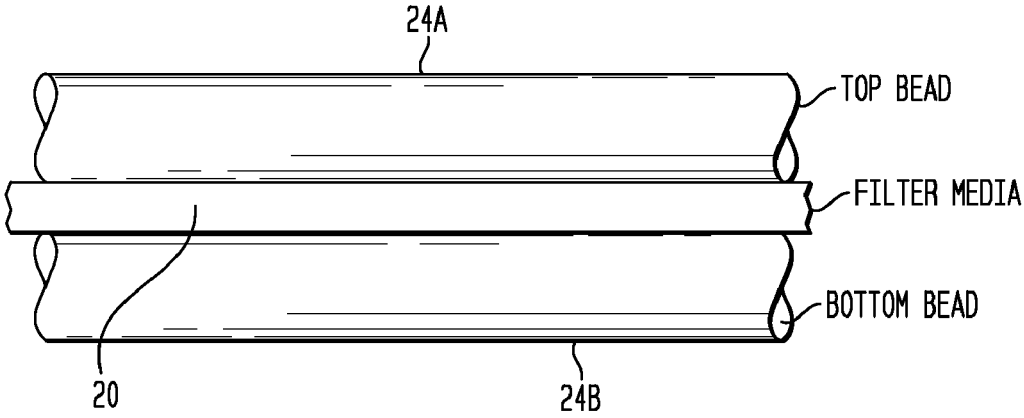
FIG. 3 is a cross-sectional view of the filter media and conductive beads of the filter shown in FIG. 2B in accordance with the present invention.

FIG. 2B and FIG. 3 provide an illustration of the use of conductive beads of the present invention in substantially flat filter media 20. In particular, a top conductive bead 22A and a bottom conductive bead 22B that are above and below the flat filter media 20 support flat filter media 20. Parallel to conductive beads 22A and 22B is an adjacent pair of rows of conductive beads, namely a top conductive bead 24A and a bottom conductive bead 24B that also support flat filter media 20.

One terminal of a high voltage power supply 108 is coupled to conductive beads 22A and 24A on the top of the media filter 20. The other terminal of the high voltage power supply 108 is coupled to conductive beads 22B and 24B on the bottom of the media filter 20.

Figure 5:
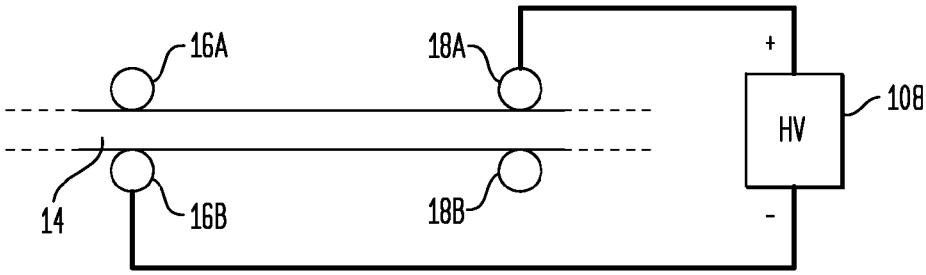
FIG. 5 illustrates a second embodiment for applying an electrostatic field to a filter media in accordance with the present invention.
Figure 6:
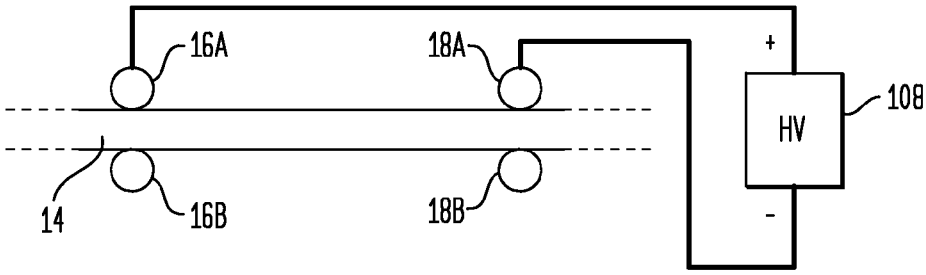
FIG. 6 illustrates a third embodiment for applying an electrostatic field to a filter media in accordance with the present invention.

Alternate ways of connecting the high voltage power supply 108 to the conductive beads on top and bottom of the filter media are shown in FIGS. 5 and 6. In FIG. 5, one terminal of the high voltage power supply 108 is connected to a first conductive bead 16B below the filter media 14. The other terminal of the high voltage power supply 108 is connected to a second conductive bead 18A above the filter media 14. Applying a high voltage potential to conductors on alternate sides of the filter media 14 forces the electrostatic field to pass through the filter media 14 and may provide a stronger electrostatic field within the interior of the filter media 14.

In FIG. 6, the one terminal of the high voltage power supply 108 is connected to a first conductive bead 16A. The other terminal of the high voltage power supply 108 is connected to a second conductive bead 18A, which is on the same side of the filter media 14 as the first conductive bead 16A. Applying a high voltage potential to conductors on the same side of filter media 14 may provide easier connections to the power supply 108.

Other combinations of connections are possible. For instance, one terminal of the high voltage power supply 108 could be connected to conductors on top and bottom of filter media 14 and the other terminal of the high voltage power supply 108 connected to a single conductor, either on top or on bottom of filter media 14.

Use of the present invention promises to make active field polarized media air cleaners easier to manufacture and therefore more economical to purchase. Although the conductive beads of present invention could be applied to either flat or pleated media, it is particularly advantageous as an integral part of the mini-pleat filter configuration with conductive glue beads.

The invention(s) disclosed above could be used in variety of ways, including, but not limited to, use in HVAC systems, self-contained filter/fan units, and industrial air cleaning systems, and dust collectors. While the above embodiments primarily describe flat filter configurations, the inventions could be adapted to other configurations as well: including but not limited to V-bank groupings of multiple flat panels, interconnected groupings of panel and V-Bank units, cylindrical filters for dust collection systems, etc. Further, any and all of these could be coupled with ionizing or polarizing arrays upstream or downstream of the device to improve efficiency.

What is claimed is:

1. A filter comprising:

a sheet of filter material;

a first conductive bead applied to the sheet of filter material and providing support for the filter material;

a second conductive bead substantially parallel to the first conductive bead applied to the sheet of filter material and providing support for the filter material wherein the first and second conductive beads are applied to opposite sides of the sheet of filter material; and a voltage power supply that provides a voltage differential between the first conductive bead and the second conductive bead to produce an electrostatic field that passes through the filter media.

2. A filter in accordance with claim 1, wherein the sheet of filter material is a minipleat material.

3. A filter in accordance with claim 1, wherein the sheet of filter material is an electret material with inherent properties that have an electrostatic charge.

4. A filter in accordance with claim 1, wherein said sheet of filter material is an electret material composed of fibers from different portions of the triboelectric scale.

5. A filter in accordance with claim 1, wherein one of the first conductive bead and the second conductive beads is substantially composed of one of the group of glue, thread, ribbon, tape, strips, glass, foam or plastic.

6. A filter in accordance with claim 1, wherein one of the first conductive bead and the second conductive beads is substantially composed of a conductive material that adheres to the surface of the sheet of filter material upon which it rests and provides some mechanical support for the sheet of filter material.

7. The filter in accordance with claim 1, wherein the sheet of filter material is pleated but not a mini-pleat.

8. The filter in accordance with claim 1, wherein the sheet of filter material is substantially flat.

9. The filter in accordance with claim 1, wherein the sheet of filter material has multiple layers.

10. A filter comprising:

a pleated sheet of filter material having a top side and a bottom side;

a first conductive bead applied to the top side of the pleated sheet of filter material and providing support for the pleated sheet of filter material; and a second conductive bead substantially parallel to the first conductive bead applied to the bottom side of the pleated sheet of filter material and providing support for the pleated sheet of filter material;

a third conductive bead applied to the top side of the pleated sheet of filter material and providing support for the pleated sheet of filter material; and a fourth conductive bead substantially parallel to the first conductive bead applied to the bottom side of the pleated sheet of filter material and providing support for the pleated sheet of filter material;

a voltage power supply that provides a voltage differential between the first conductive bead and the second conductive bead, and the third conductive bead and fourth conductive bead, to produce an electrostatic field that passes through the filter media.

11. A filter in accordance with claim 10, wherein the pleated sheet of filter material is an electret material with inherent properties that have an electrostatic charge.

12. A filter in accordance with claim 10, wherein the pleated sheet of filter material is an electret material composed of fibers from different portions of the triboelectric scale.

13. A filter in accordance with claim 10, wherein one of the first, second, third and fourth conductive beads is substantially composed of one of the group of glue, thread, ribbon, tape, strips, glass, foam or plastic.

14. A filter in accordance with claim 10, wherein one of the first, second, third and fourth conductive beads is substantially composed of a conductive material that adheres to the surface of said pleated sheet of filter material upon which it rests and provides some mechanical support for the pleated sheet of filter material.

15. The filter in accordance with claim 10, wherein the sheet of filter material is a mini-pleat.

16. The filter in accordance with claim 10, wherein the pleated filter material is a not a mini-pleat.

17. The filter in accordance with claim 10, wherein the sheet of filter material has multiple layers.

18. A filter comprising:

a bag filter;

a first conductive bead applied to the bag filter and providing support for the bag filter;

a second conductive bead substantially parallel to the first conductive bead applied to the bag filter and providing support for the bag filter wherein the first and second conductive beads are applied to opposite sides of the bag filter; and a voltage power supply that provides a voltage differential between the first conductive bead and the second conductive bead to produce an electrostatic field that passes through the bag filter.

* * * * *